US010272975B2

(12) United States Patent
Fishler

(10) Patent No.: US 10,272,975 B2
(45) Date of Patent: Apr. 30, 2019

(54) GAS HYDRATE TRANSPORTATION AND STORAGE SYSTEM AND METHOD

(71) Applicant: Yehoshua Fishler, Shoham (IL)

(72) Inventor: Yehoshua Fishler, Shoham (IL)

( * ) Notice: Subject to any disclaimer, the term of this patent is extended or adjusted under 35 U.S.C. 154(b) by 0 days.

(21) Appl. No.: 15/540,314

(22) PCT Filed: Dec. 28, 2015

(86) PCT No.: PCT/IB2015/060015

§ 371 (c)(1),
(2) Date: Jun. 28, 2017

(87) PCT Pub. No.: WO2016/108177

PCT Pub. Date: Jul. 7, 2016

(65) Prior Publication Data

US 2018/0001972 A1 Jan. 4, 2018

Related U.S. Application Data

(60) Provisional application No. 62/097,101, filed on Dec. 28, 2014.

(51) Int. Cl.
*B63B 25/16* (2006.01)
*B63B 5/00* (2006.01)
(Continued)

(52) U.S. Cl.
CPC ..... *B63B 25/16* (2013.01); *B63B 5/00* (2013.01); *B63B 9/06* (2013.01); *C10L 3/108* (2013.01);
(Continued)

(58) Field of Classification Search
CPC ..... B63B 9/06; B63B 5/00; B63B 25/16
See application file for complete search history.

(56) References Cited

U.S. PATENT DOCUMENTS 3,593,354 A 7/1971 Carter et al.
5,058,357 A 10/1991 Newsom
(Continued)

FOREIGN PATENT DOCUMENTS

JP 405077318 UI 10/1993
JP H05-077318 10/1993
(Continued)

OTHER PUBLICATIONS

J.S. Gudmundsson and A. Borrehaug, Frozen Hydrate for Transport of Natural Gas, Proceedings, 2nd International Conference Natural Gas Hydrates, Jun. 2-6, 1996, Toulouse, France, pp. 415-422.

*Primary Examiner* — Stephen P Avila
(74) *Attorney, Agent, or Firm* — The Watson IP Group, PLC; Jovan N. Jovanovic

(57) ABSTRACT

Disclosed is a marine vessel to transport natural gas hydrates (NGH), the marine vessel includes a hull formed from solid NGH and a skeletal structure to support the hull. Additionally disclosed is a container to transport NGH including a block of solid NGH and a skeletal structure to support the block. Further disclosed is a method of fabricating a marine vessel for transporting and storing natural gas hydrates (NGH), the method includes preparing a mold, placing a skin layer in the mold, assembling a skeletal structure in the mold, preparing a NGH slurry, and pouring into NGH slurry into the mold.

32 Claims, 6 Drawing Sheets

(51) Int. Cl.

| | |
|---|---|
| ***B63B 9/06*** | (2006.01) |
| ***C10L 3/10*** | (2006.01) |
| ***F17C 1/00*** | (2006.01) |
| ***F17C 1/12*** | (2006.01) |
| ***F17C 11/00*** | (2006.01) |

(52) U.S. Cl.
CPC ..... *F17C 1/002* (2013.01); *F17C 1/12* (2013.01); *F17C 11/007* (2013.01); *F17C 2221/033* (2013.01); *F17C 2260/02* (2013.01); *F17C 2270/0105* (2013.01)

(56) References Cited

U.S. PATENT DOCUMENTS

| | | | | |
|---|---|---|---|---|
| 6,028,234 | A * | 2/2000 | Heinemann | C10L 3/08 137/13 |
| 6,170,425 | B1 | 1/2001 | Blount | |
| 7,094,341 | B2 * | 8/2006 | Max | C02F 1/22 210/170.11 |
| 8,354,565 | B1 | 1/2013 | Brown et al. | |
| 2005/0194299 | A1 | 9/2005 | Max | |
| 2010/0062094 | A1 | 3/2010 | Watanabe et al. | |
| 2010/0205859 | A1 | 8/2010 | Iwasaki et al. | |
| 2011/0217210 | A1 | 9/2011 | Katoh et al. | |
| 2014/0203471 | A1 | 7/2014 | Iwabuchi et al. | |

FOREIGN PATENT DOCUMENTS

| | | | |
|---|---|---|---|
| JP | 2002089098 | A | 3/2002 |
| JP | 2004070249 | A | 3/2004 |
| KR | 20030004434 | | 1/2003 |
| KR | 20110072523 | | 6/2011 |
| KR | 20110072523 | A | 6/2011 |
| KR | 1020110072523 | A | 6/2011 |
| KR | 1020110072523 | A1 | 6/2011 |
| KR | 20140063261 | A | 5/2014 |
| KR | 1020140063261 | A | 5/2014 |
| WO | 03006308 | A1 | 1/2003 |
| WO | 2013171523 | A3 | 11/2013 |
| WO | 2015087268 | A2 | 6/2015 |

* cited by examiner

GAS HYDRATE TRANSPORTATION AND STORAGE SYSTEM AND METHOD

CROSS-REFERENCE TO RELATED APPLICATIONS

This application claims the benefit of priority from U.S. Provisional Patent Application No. 62/097,101 filed Dec. 28, 2014, the contents of which are incorporated herein by reference in their entirety.

FIELD AND BACKGROUND OF THE INVENTION

The present invention, in some embodiments thereof, relates to gaseous fluids in general, and more particularly, but not exclusively, to a system and method for transporting and storing gas hydrates.

For decades, storage and transport of natural gas has been problematic and expensive, preventing the exploitation of many small and medium-sized natural gas fields. Generally, the gas is transported over pipelines to a processing plant where the gas is liquefied and stored as liquefied natural gas (LNG) or compressed and stored as compressed natural gas (CNG). Distribution of the LNG and CNG from the processing plant is then generally done by sea vessels and/or land vehicles specially adapted to contain the gas in its respective form.

In an attempt to overcome the high costs and transportation difficulties associated with natural gas transport and storage and promote the exploitation of small and medium-sized natural gas fields, a relatively recent trend is to promote the use of clathrates technology. This involves converting the natural gas into natural gas hydrates (NGH) which may be processed as hydrate slurry or further processed into other forms, including hydrate pellets, and may provide an economical option for both storing and transporting natural gas and other gases as an alternative to liquefying or compression.

Clathrates are non-stoichiometric crystalline compounds consisting of at least two molecular species, where one species physically entraps the others within a cage-like structure. The species forming the cage-like structure is commonly referred to as the host, while the caged component is commonly referred to as the guest. When the cage-like structure is made up of water molecules bonded together, the crystalline compounds formed are known as clathrate hydrates or gas hydrates.

In gas hydrates, the host-lattice is created by water molecules connected together through hydrogen bonding. The guest molecule is held in place inside cavities of the hydrogen-bonded water molecules, and the lattice is stabilized by van der Weals forces between host and guest molecules without chemical bonding between the host-lattice and guest molecule. The host-lattice is thermodynamically unstable without the presence of a guest molecule in the cavity, and without the support of the trapped molecules, the lattice structure of gas hydrates will collapse into conventional ice crystal structures or liquid water. Most low molecular weight gases, including O2, H2, N2, CO2, CH4, H2S, Ar, Kr, and Xe as well as some higher hydrocarbons and freons, will form hydrates at suitable temperatures and pressures.

Use of NGH as a substitute for LNG and CNG generally involves three stages; production, transportation, and regasification. Some examples of systems and methods for producing gas hydrates and gas hydrate slurry and for regasification are disclosed in US Patent Application Publication No. US 2011/0217210 to Katoh et al., WIPO International Publication WO 2015/087268 to Sangwai, U.S. Pat. No. 8,334,418 to Osegovic et al., and U.S. Pat. No. 8,354,565 to Brown et al. Some examples of systems and methods for transporting the gas hydrate in marine vessels are disclosed in "Frozen Hydrate for Transport of Natural Gas", Gudmundsson, J. S. and Borrehaug, A., Proceedings, 2$^{nd}$ International Conference Natural Gas Hydrates, Jun. 2-6, 1996, Toulouse, pp. 415-422; Japanese Patent Application No. 2004-070249, "Gas-Hydrate Transportation Vessel", to Ichiji et al.; and Japanese Patent Application No. 2002-089098, "Gas Hydrate Pellet Transport Ship", to Ichiji et al.

SUMMARY OF THE INVENTION

There is provided, in accordance with an embodiment of the present invention, a marine vessel to transport natural gas hydrates (NGH), the marine vessel including a hull formed from solid NGH and a skeletal structure to support the hull.

There is further provided, in accordance with an embodiment of the present invention, a container to transport natural gas hydrates (NGH) including a block of solid NGH, and a skeletal structure to support the block.

In accordance with an embodiment of the present invention, the solid NGH includes additives.

In accordance with an embodiment of the present invention, the additives include any one of sand, clay, wood, hemp, and phase changing materials.

In accordance with an embodiment of the present invention, the vessel includes a liner to envelop an exterior of the hull.

In accordance with an embodiment of the present invention, the liner is hydrophobic.

In accordance with an embodiment of the present invention, the liner is hermetically sealed to gas and liquids.

In accordance with an embodiment of the present invention, the liner is thermally insulating.

In accordance with an embodiment of the present invention, the hull is integrally formed from solid NGH.

In accordance with an embodiment of the present invention, the hull is formed from sections of solid NGH.

In accordance with an embodiment of the present invention, the hull is formed from a plurality of containers including the solid NGH.

In accordance with an embodiment of the present invention, the skeletal structure is included in the plurality of containers.

In accordance with an embodiment of the present invention, the vessel is one of a self-propelled vessel or a towable vessel.

In accordance with an embodiment of the present invention, the skeletal structure is suitable to transport a cooling fluid through the solid NGH.

In accordance with an embodiment of the present invention, the solid NGH is frozen.

There is provided, in accordance with an embodiment of the present invention, a method of fabricating a marine vessel for transporting and storing natural gas hydrates (NGH), the method including preparing a mold, placing a skin layer in the mold, assembling a skeletal structure in the mold, preparing a NGH slurry, and pouring the NGH slurry into the mold.

In accordance with an embodiment of the present invention, the method includes mixing an additive into the NGH slurry.

In accordance with an embodiment of the present invention, the method includes solidifying the NGH slurry.

In accordance with an embodiment of the present invention, the method includes solidifying the NGH slurry into a section of a hull of the marine vessel.

In accordance with an embodiment of the present invention, the method includes shaping the NGH slurry into a frozen solid block.

In accordance with an embodiment of the present invention, the method includes submerging the mold in water.

In accordance with an embodiment of the present invention, the method includes storing the solid NGH submerged in water.

In accordance with an embodiment of the present invention, the method includes dismantling the skeletal structure following regasification of the solid NGH.

In accordance with an embodiment of the present invention, the container includes a barrier to envelop an exterior of the solid NGH block.

In accordance with an embodiment of the present invention, the barrier is hydrophobic.

In accordance with an embodiment of the present invention, the barrier is hermetically sealed to gas and liquids.

In accordance with an embodiment of the present invention, the barrier is thermally insulating.

In accordance with an embodiment of the present invention, the container is transportable on a marine vessel.

In accordance with an embodiment of the present invention, the container is suitable to form a hull of a marine vessel.

In accordance with an embodiment of the present invention, the container is transportable on a commercial overland transport vehicle.

In accordance with an embodiment of the present invention, the skeletal structure is suitable to transport a cooling fluid through the block of solid NGH.

BRIEF DESCRIPTION OF THE DRAWINGS

Some embodiments of the invention are herein described, by way of example only, with reference to the accompanying drawings. Details shown are for exemplary purposes and serve to provide a discussion of embodiments of the invention. The description and the drawings may be apparent to those skilled in the art how embodiments of the invention may be practiced.

DETAILED DESCRIPTION

Figure 1:
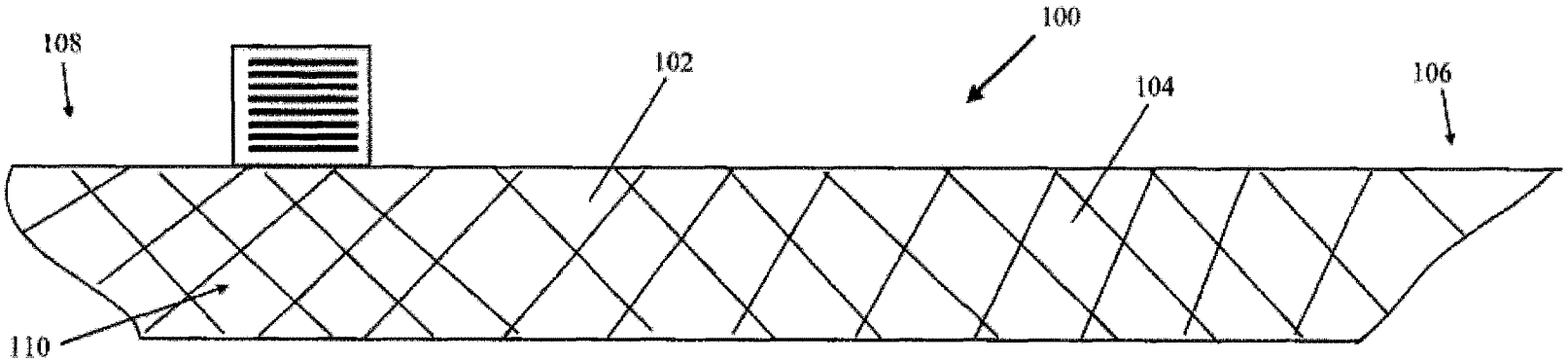
FIG. 1 schematically illustrates an exemplary NGH marine vessel including a solid NGH hull, according to an embodiment of the present invention.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

The main cost associated with the transportation of NGH is the purchase and the operation of marine vessels, whether self-propelled or towable, used for transporting the NGH. A disadvantage in transporting NGH compared to LNG is that NGH contains approximately between 5-7 tons of water for each ton of NG, while LNG contains only natural gas. The additional weight associated with NGH requires both larger marine vessels and more fuel costs for transport compared to LNG. Consequently, NGH vessels may be required to transport between 6 to 8 times the weight that LNG vessels must transport for the same revenue shipment. Thus, the increased weight of transporting NGH may require use of larger vessels and/or more vessels for transporting the same amount of gas as transported by LNG vessels, which may make negatively affect the economic feasibility when compared to LNG.

Applicant has realized that present system and methods for transporting NGH suffer from several drawbacks, among them the previously mentioned disadvantage of requiring either larger transportation vessels and/or more vessels compared with that required for LNG transport. Other drawbacks include the economic effect of having to return these larger and/or numerous transportation vessels empty to the NGH production facility following delivery of the NGH.

Applicant has realized that the drawbacks associated with transporting NGH may be overcome by using a marine vessel partially manufactured from the NGH which is to be transported, and which may be assembled at the NGH production facility. This NGH vessel may be designed so that, when the NGH is regasified at the regasification facility, the non-NGH parts of the vessel which remain may be dismantled and sent from the regasification facility to the production facility for reuse in a new vessel. As may be clearly appreciated, this new NGH vessel may be substantially advantageous over existing NGH vessels as the size of the vessel may be smaller compared to those presently known in the art since the transported NGH forms part of the vessel. Furthermore, the dismantled non-NGH parts may be shipped back to the production facility, inclusively using commercial transport means, for example inside marine transport containers, providing for a substantial savings compared to returning an empty NGH vessel.

In some embodiments of the present invention, the hull of the marine vessel may be constructed from solid NGH reinforced by non-NGH structural elements and covered by a skin layer which is hermetic to liquids and gases and may also be thermally insulating. The non-NGH structural elements may serve to provide structural rigidity to the hull. They may additionally serve to transport a cooling fluid and/or a pressurized gas used to maintain the NGH in a solid state, which may also include a frozen solid state. The skin layer may serve to assist in preserving the NGH in its solid state and to prevent gas evaporation and flaring during construction of the vessel and during transport. This skin layer may also serve as an envelope to contain the natural gas produced during the regasification process. Optionally, the solid NGH hull and/or the solid NGH containers, including the non-NGH components and the skin layer, may be buoyant in water, including seawater.

In some embodiments of the present invention, the solid NGH hull may be integrally formed at the production facility as a single component inside a hull-shaped forming mold or may be assembled from a number of solid hull sections which may be joined together to form the solid NGH hull. In some embodiments, the solid NGH container hull may be assembled from a plurality of solid NGH containers which are joined together. These solid NGH containers may each be individually formed at the production facility inside container forming molds which may include the shape of the section of the hull which each container will occupy.

In some embodiments of the present invention, the forming mold may be incorporated and assembled with the non-NGH structural elements which may form part of the solid NGH hull or of the solid NGH containers. The form may also be fitted with the skin layer which will be used to cover the solid hull's outer surface area or the outer surface area of the solid NGH containers. Optionally, the skin layer may also be used to cover an inner surface area of the solid NGH hull. For convenience hereinafter, the forming mold assembled with the structural elements and the skin layer may be referred to as "assembled mold".

In some embodiments of the present invention, the solid NGH hull or the solid NGH containers may be formed underwater in the production facility, for example, by sinking the assembled mold in seawater and filling it with the seawater. Sinking the mold in the seawater may be advantageous as the underwater hydrostatic pressure may be utilized for producing or preserving the solid NGH. Natural gas may then be introduced into the assembled mold to form NGH slurry, which may then be subjected to cooling and/or pressure underwater to transform it into the solid NGH. Optionally, an additive such as sand, clay, wood (e.g. wood fibers, sawdust, etc.), hemp, or other materials suitable for increasing among other qualities the resistance to thermal conduction and to thermal inertia of the solid NGH, and to increase its structural characteristics including the structural stable rigidity, may be introduced into the slurry. The additives may be in introduced in the form of pellets, although not limited to use of pellets, and may also include use of phase changing materials (PCM). Once formed, the solid NGH hull or the solid NGH containers may be stored underwater by lashing (anchoring) it to the sea bed or by adding weights to the sunken body to create a negative buoyancy state until the marine vessel is ready to be assembled or, following assembly, until the solid NGH is ready to be regasified. When ready for use, the solid NGH hull or the solid NGH containers may be detached from the form and allowed to float to the surface of the water. Alternatively, the assembled mold may be above ground and the solid NGH hull and/or solid NGH containers formed above ground.

In some embodiments, the solid NGH hull and the solid NGH container hull are suitable for use on any type of marine vessel intended for transporting the NGH. These may include self-propelled marine vessels as well as towable marine vessels, including ships and barges. The hulls may be fitted with appropriate systems, equipment, machinery, and accessories for allowing proper vessel operation, including engines and navigation equipment and systems if the vessel is self-propelled, and including cooling equipment and/or pressurizing equipment to maintain the NGH in its solid state. Preferably, these systems, equipment, machinery and accessories will be dismantable to components sized to be transportable on commercial-size trucks and other overland transportation vessels, including tractor-trailers and transport vehicles which may conform to Incoterm rules and/or guidelines.

Reference is now made to FIG. 1 which schematically illustrates an exemplary NGH marine vessel 100 including a solid NGH hull 102, according to an embodiment of the present invention. Solid NGH hull 102 may be integrally formed as a single component inside a hull-shaped forming mold (not shown), or alternatively may be fabricated in separate sections which may be joined together.

NHG marine vessel 100 may include a self-propelled vessel such as a ship as shown in the figure, but may otherwise include any other type of self-propelled marine vessel or towable vessel such as, for example, a barge or a towable cargo vessel. NGH hull 102 may extend from bow 106 to stern 108, all of which may be formed from solid NGH 104. Alternatively, NGH hull 102 may include solid NGH 104 along a portion of its length, with bow 106 and/or stern 108 being fabricated from a non-NGH material, for example, from steel as is common practice in most marine vessels.

NGH hull 102 may include skin layer 110 which may assist in preserving NHG 104 in its solid state and which may also serve to prevent gas evaporation and flaring of the solid NHG 104. Skin layer 110 may also serve to prevent water from coming into contact with solid NHG 104 and may provide thermal insulation. Skin layer 110 may additionally serve as a container to prevent gas from escaping during regasification of solid NHG 104. Skin layer 110 may include materials known in the art and may include a single liner material suitable to provide the required liquid and gas hermetic sealing, and thermal insulation, or may combine a number of liners and/or materials the combination of which may provide the required characteristics. Skin layer 110 may include a relative smooth finish or be treated with a smoothing primer to reduce friction between the vessel and the sea during transport.

NHG vessel 100 may be equipped with equipment, machinery, and accessories and components which may be mounted onto the NGH hull 102 following fabrication of the hull as part of a vessel assembly process in the NGH production facility, and which may be dismounted from the vessel prior to, or following, regasification of solid NHG 104. These may include structural elements used to provide structural integrity to NGH hull 102, systems which may be used to propel and navigate the vessel, and systems which may be used to maintain NGH 104 in its solid state, dismantable structures (e.g. living quarters) among others.

Figure 2:
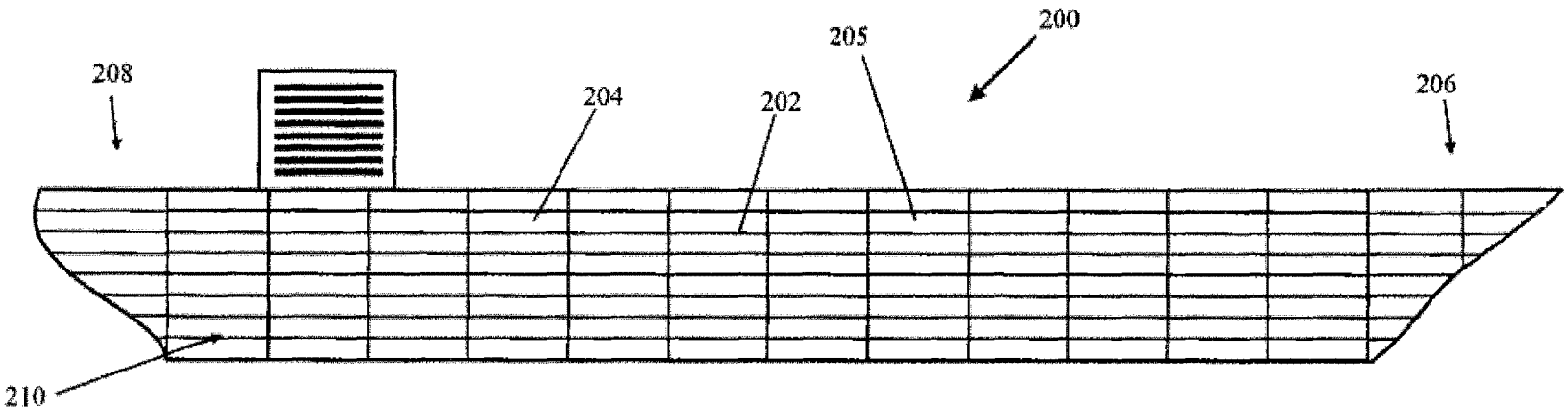
FIG. 2 schematically illustrates an exemplary NGH marine vessel including a solid NGH container hull, according to an embodiment of the present invention.

Reference is now made to FIG. 2 which schematically illustrates an exemplary NGH marine vessel 200 including a solid NGH container hull 202, according to an embodiment of the present invention. Solid NGH container hull 202 may be assembled from NGH containers 205 with solid NGH 204, each container formed inside a container-forming mold (not shown).

Similarly to NHG marine vessel 100, NGH marine vessel 200 may include any type of self-propelled marine vessel or towable vessel. Solid NGH container hull 502 may extend from bow 206 to stern 208 and may include solid NGH containers 205 connected to one another with each container optionally shaped to match the contour of the hull according to its position in the hull. Each NGH container 205 may include structural elements (not shown) to provide structural rigidity to the container itself and overall to NGH container hull 202. Similarly to NGH marine vessel 100, in an alternative embodiment, NGH containers 205 may be used along a portion of the length of the hull, with bow 206 and/or stern 208 being fabricated from non-NGH materials such as steel. A more complete description of NGH container 205 is provided further on below with reference to FIGS. 5A-5E. Similarly to NGH vessel 100, NGH hull 202 may include an skin layer 210 functionally similar skin layer 110.

Similarly to NGH vessel 100, NGH vessel 200 may be equipped with equipment, machinery, and accessories and components which may be mounted onto NGH container hull 202 following assembly of the hull as part of a vessel assembly process in the NGH production facility, and which may be dismounted from the vessel prior to, or following, regasification of solid NHG 204. These may include the structural elements used to provide structural integrity to solid NGH container 205, systems which may be used to propel and navigate the vessel, and systems which may be used to maintain solid NGH 204 in its solid state, dismantable structures (e.g. living quarters) among others.

Figure 3:
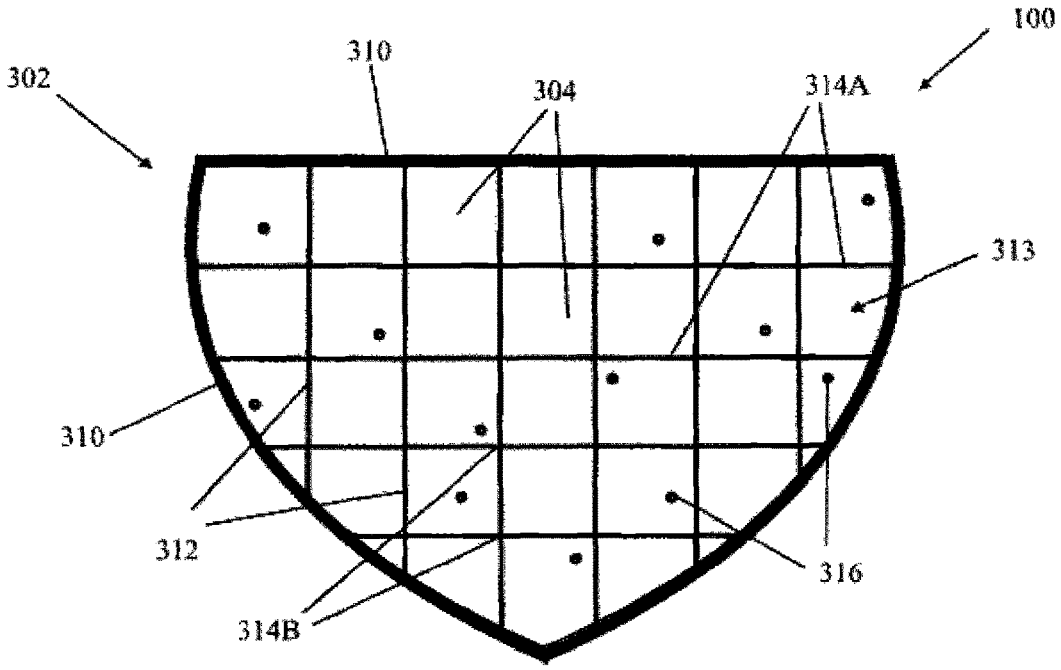
FIG. 3 schematically illustrates a cross-section of an exemplary solid NGH hull, according to an embodiment of the present invention.

Reference is now made to FIG. 3 which schematically illustrates a cross-section of an exemplary solid NGH hull 302 in a marine vessel 100, according to an embodiment of the present invention. Optionally, NGH hull 302 may be formed in separate sections which are joined together. NGH hull 302 may include solid NGH 304, a skeletal structure 313, NGH additives 316, and skin layer 310.

Solid NGH 304 may occupy the whole interior volume of NGH hull 302, or alternatively a major portion of the volume, and may be produced by solidifying a NGH slurry using methods known in the art for forming the slurry and for further converting the slurry into a solid. Optionally, the solid may be in a frozen state. Included in solid NGH 304 may be additives 316 which may be added to the slurry prior and which may serve to increase among other qualities the resistance to thermal conduction and to thermal inertia of the solid NGH and also to increase its structural characteristics including its structural stable rigidity. Additives 316 may include any combination of sand, clay, wood, hemp, or other materials including PCMs, and may be provided as a grain or any other suitable shape, including encapsulated in pellets. NGH hull 302 may be enveloped by skin layer 310, which may be similar to skin layer 110 previously described with reference to FIG. 1. Skeletal structure 313 may provide structural rigidity to NGH hull 302 and may include any combination of non-NGH vertical structural elements 312, non-NGH diagonal structural elements 312A, and non-NGH horizontal structural elements 314A and 314B. Skeletal structure 313 may include a truss structure which may be wholly or partially embedded in solid NGH 304 with structural elements 312, 312A, 314A and/or 314B acting as structural members supporting the truss. Structural elements 312, 312A, 314A and/or 314B may include pipes (steel or other suitable metal or material) of a suitable diameter and wall thickness to provide the required structural rigidity, some of which, or all of which, may include a hollow core through which a cooling fluid may flow along the length of the pipes to assist in keeping the NGH in a solid state if cooling is required. Structural elements 312, 312A, 314A and 314B may be interconnected so as to allow the cooling fluid to flow through some, alternatively through all, of the pipes if cooling is required. Alternatively, structural elements 312, 312A, 314A and/or 314B may include any other type of suitable structural element which may serve to provide the required structural rigidity and which may be fitted with means to transport the cooling fluid if required. Skeletal structure 313 may be dismantable so that structural elements 312, 312A, 314A and 314B may be individually removed from NGH hull 302 following regasification. The individual structural elements may be optionally shipped using overland and/or marine commercial transport means to a destination other than the regasification facility, and may include reshipping back to the production facility for use in the building of a new marine vessel.

Figure 4:
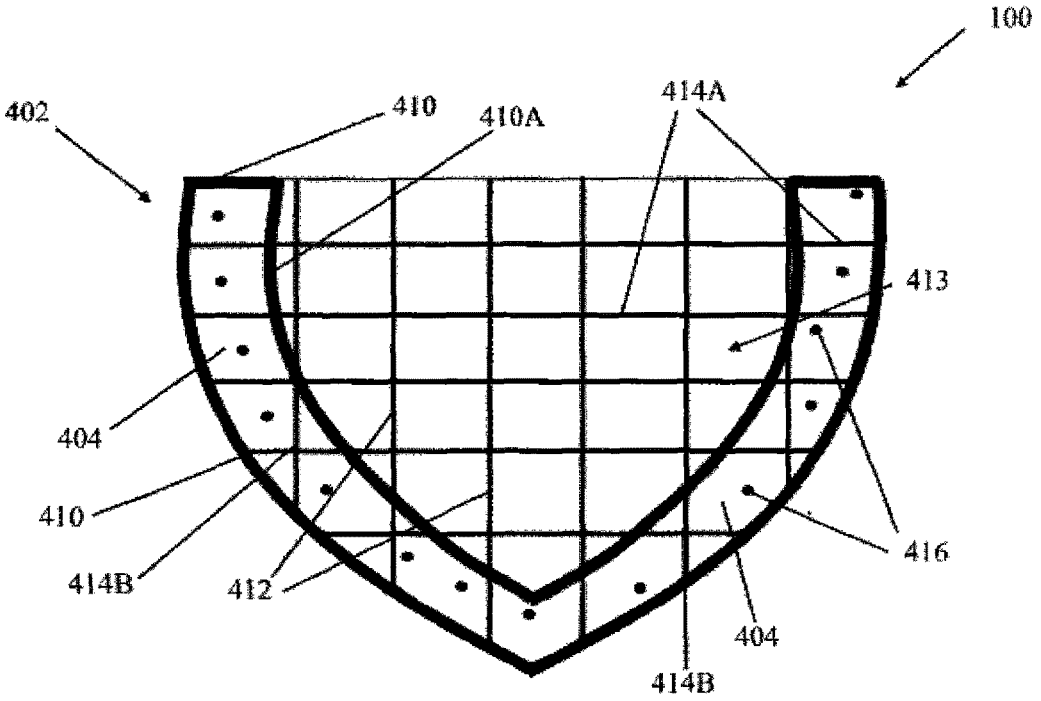
FIG. 4 schematically illustrates a cross-section of an exemplary solid NGH hull, according to some embodiments of the present invention.

Reference is now made to FIG. 4 which schematically illustrates a cross-section of an exemplary solid NGH hull 402 in a marine vessel 100, according to some embodiments of the present invention. Optionally, solid NGH hull 402 may be formed in separate sections which are joined together. NGH hull 402 may include solid NGH 404, a skeletal structure 413, NGH additives 416, skin layer 410, and an inner skin layer 410A.

Solid NGH hull 402 may resemble NGH hull 302 modified so that solid NGH 404 does not occupy a major portion (or the whole) of the interior volume of the hull as in NGH hull 302 rather a strip or band proximal to the sides of the hull, as shown in FIG. 4. Consequently, skeletal structure 413, which may include any combination of non-NGH vertical structural element 412, non-NGH diagonal structural element 412A and non-NGH horizontal structural elements 414A and 414B and which may be functionally similar to skeletal structure 313, may have a limited number of structural elements embedded in solid NGH 404. Additionally or alternatively, non-structural cooling pipes may be included within solid NGH 404 to assist cooling the solid NGH as required. Similarly to skeletal structure 313, skeletal structure 413 may also be dismantable and structural elements 412, 412A, 414A and 414B reusable in a new marine vessel.

Skin layer 410 may be functionally similar to skin layer 310 in FIG. 3. Inner skin layer 410A may envelop solid NGH 404 from within the interior volume of solid NGH hull 402, and may be functionally similar to skin layer 410 with the exception that the hydrophobic and friction-reducing characteristics of the outer insulation skin layer may not necessarily be required in skin layer 410A.

Figure 5A:
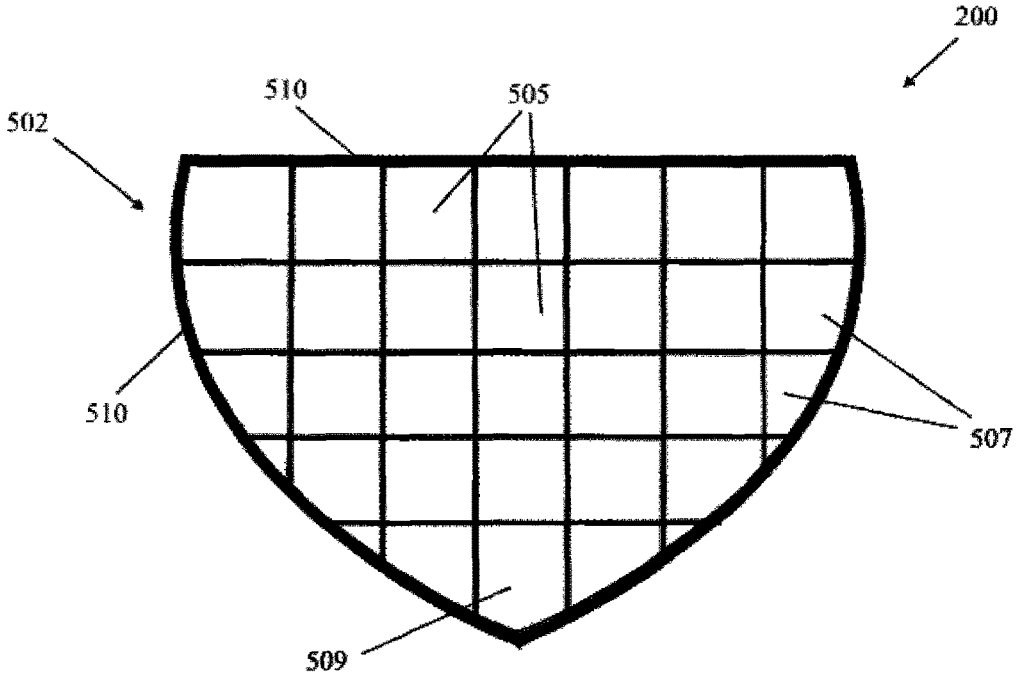
FIG. 5A schematically illustrates a cross-section of an exemplary NGH hull assembled from solid NGH containers and including an enveloping exterior skin layer, according to an embodiment of the present invention.
Figure 5B:
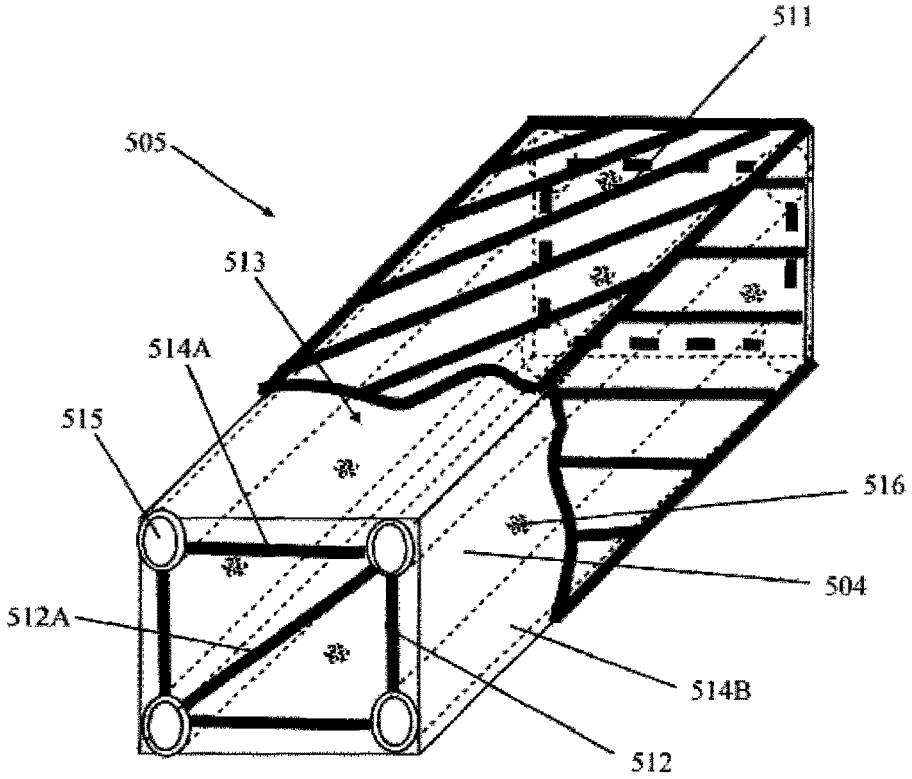
FIG. 5B schematically illustrates a perspective view of a typical rectangular-shaped solid NGH container, according to embodiments of the present invention.
Figure 5C:
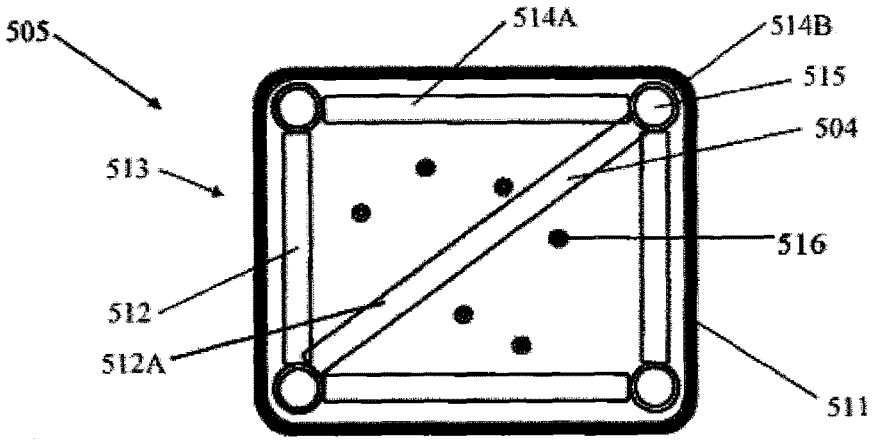
FIG. 5C schematically illustrates a cross-sectional view of the rectangular-shaped solid NGH container, according to embodiments of the present invention.
Figure 5D:
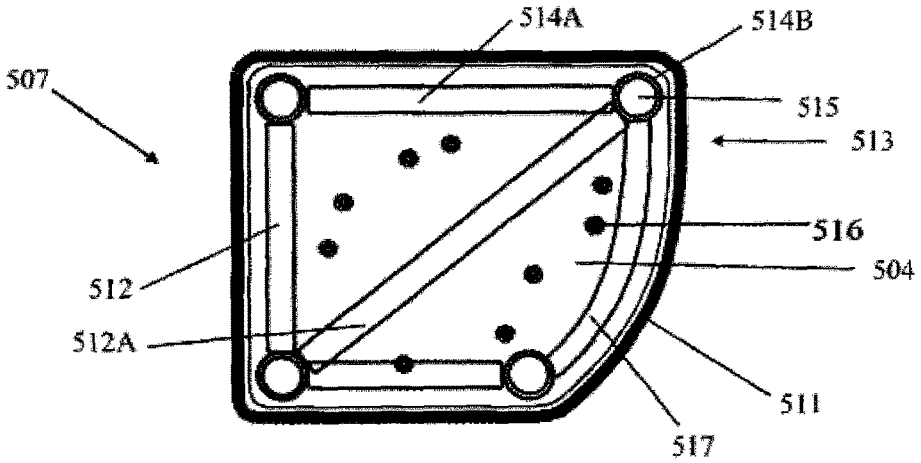
FIG. 5D schematically illustrates a cross-sectional view of a solid NGH container shaped to form a side of the NGH container hull, according to an embodiment of the present invention.
Figure 5E:
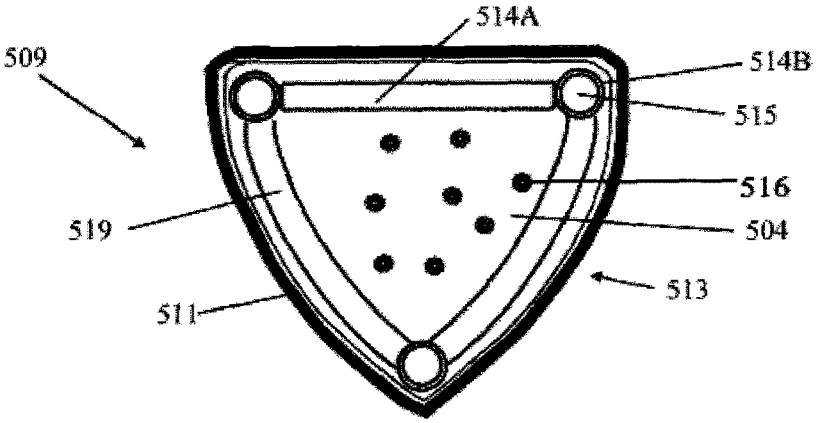
FIG. 5E schematically illustrates a cross-sectional view of a solid NGH container shaped to form the bow of the solid NGH container hull, according to an embodiment of the present invention.

Reference is now made to FIG. 5A which schematically illustrates a cross-section of an exemplary solid NGH container hull 502 in marine vessel 200 including solid NGH containers 505, 507 and 509, and skin layer 510, according to an embodiment of the present invention. Reference is also made to FIGS. 5B and 5C which schematically illustrate a perspective view and a cross-sectional view of a typical rectangular-shaped solid NGH container 505, and to FIGS. 5D-5E which schematically illustrate cross-sections of contoured solid NGH containers 507 and 509 corresponding to a shape of solid NGH container hull 502, according to embodiments of the present invention.

NGH containers 505, 507 and 509 may include solid NGH 504, a skeletal structure 513, additives 516, and a barrier layer 511 enveloping the NGH containers. NGH containers 505, 507, and 509 may be mounted one on top of the other, and side by side, inside NGH hull 502 to form a rigid structure which may support the hull. This mounting configuration may resemble that of commercial containers mounted on marine vessels. NGH container 505 may be sized to be transported with solid NGH 504 using known commercial overland transport vehicles, containers, and transport platforms, and may include those conforming to Incoterm rules and/or guidelines, among other.

Solid NGH 504 may be produced as a rectangular solid NGH block using techniques known in the art, as previously described with reference to solid NGH 304. NGH 504 may include additives 516 which may be similar to additives 316. Barrier layer 511 may be functionally similar to skin layer 510.

Skeletal structure 513, similarly to skeletal structure 313, may include a truss structure which may be embedded in the solid NGH and/or may be peripherally located along the edges of the solid NGH block, and may serve to support the block and to provide structural rigidity to NGH container hull 502 when all NGH containers are assembled in place within the hull. In solid NGH container 505, Non-NGH vertical structural elements 512, non-NGH diagonal structural elements 512A, and non-NGH horizontal structural elements 514A and 514B may be functionally similar to structural elements 312, 314A and 314B, respectively, and may include pipes through which cooling fluid may flow through all or some of the structural elements. FIG. 5B illustrates an exemplary structural pipe 514B with a hollow core 515 through which the cooling fluid may flow. In solid NGH container 507, a non-structural element 517 is shaped to conform to the contour of a side of NGH container hull 502 in the section of the hull where the container is to be positioned. Similarly in NGH container 509, non-structural elements 519 are shaped to conform to the contour of the bottom of NGH container hull 502.

Figure 6:
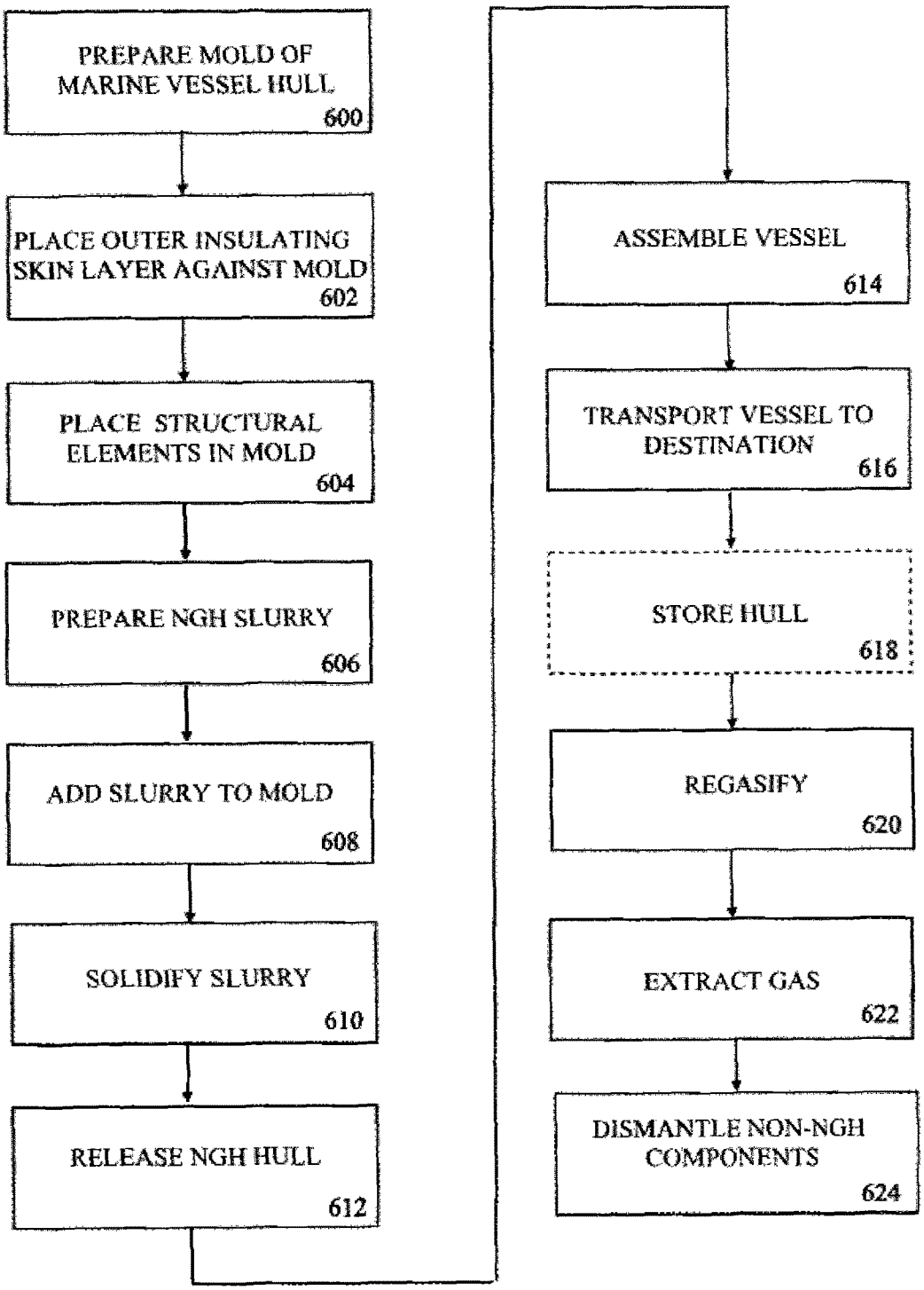
FIG. 6 is a flow chart of an exemplary method of producing a solid NGH hull and a NGH marine vessel operative to transport and store solid NGH, according to an embodiment of the present invention.

Reference is now made to FIG. 6 which is a flow chart of an exemplary method of producing a solid NGH hull and a NGH marine vessel operative to transport and store solid NGH, according to an embodiment of the present invention. Optionally, the NGH hull may be formed in separate sections which are joined together. The skilled person may appreciate that the exemplary method shown and described herein below may be practiced with modifications, which may include more or less steps and/or a different sequence of steps. For convenience, the method is described with reference to the embodiment of the present invention shown in FIG. 3, although the skilled person may readily appreciate that the method may be similarly practiced with other embodiments of the present invention.

At 600, a mold contoured to the shape of solid NGH hull 302 is prepared. Optionally, several molds contoured to the shape of different sections of solid NGH hull 302 are prepared, the different sections to be joined together in a later step of the method to form a single hull.

At 602, skin layer 310 is placed inside the mold following the contour of NGH hull 302. Insulating skin layer 310 may serve as an envelope to contain the NGH when poured into the mold, as described in the following steps.

At 604, skeletal structure 313 and other required structural elements are assembled inside the mold enveloped by insulating skin layer 310. The assembled mold may be submerged in water, for example, in sea water. Alternatively, the assembled mold may be partially submerged in water, or left on dry land. In the water, the mold may be held in place by anchoring or by use of weights.

At 606, a NGH slurry is prepared using known techniques. Additives 316 are added to the slurry.

At 608, the NGH slurry with the additives is poured into the insulating skin layer 310 inside the mold, in the required quantity according to the volume of NGH to be transported.

At 610, the slurry is solidified to form solid NGH 304 in the shape of NGH hull 302. Optionally, the solid NGH 304 is in the shape of the different sections of NGH hull 302 which are formed and are to be joined together to form a single hull. Known techniques may be used to form the solid NGH 304, and may include use of pressure and/or cooling, including freezing. Pressurization may include the use of pressurizing equipment and/or water depth pressure when submerged in water and may range from, but not be limited to 0-100 bars. Cooling may include use of cooling equipment and cooling temperature may range from, but not be limited to 0°-minus 50° C. NGH hull 302 may be left submerged in water, stored inside the mold once formed until needed. Alternatively, the mold may be removed under water and NGH hull 302 may remain stored under water as required. Alternatively, NGH hull may be left on dry land either inside or outside the mold. Pressurization and/or cooling may be maintained while submerged or outside of the water.

At 612, NGH hull 302 is released for use. Optionally, NGH hull 302 is released in different sections if formed as different sections which are to be joined together to form the single hull. If submerged in water, the buoyancy of the hull will cause it to float to the water surface when released. NGH hull 302 may then be moved to a dry dock for assembling NGH marine vessel 100. If on dry land, NGH hull 302 may be transported to the dry dock for marine vessel assembly. Alternatively, assembly on dry land may not require use of the dry dock.

At 614, NGH marine vessel 100 is assembled. Optionally, the different hull sections are joined together if separately formed. Marine vessel 100 may be a self-propelled marine vessel or a towable vessel. Dismantable propulsion and navigation systems, dismantable structures, and other removable equipment, accessories, and components, as applicable depending on whether the vessel is self-propelled or towable, may be fitted onto NGH hull 302. Optionally, bow 106 and stern 108 (see FIG. 1) may be attached to NGH hull 302.

At 616, NGH marine vessel 100 travels to its destination which may be a regasification facility. Alternatively, NGH marine vessel 100 may travel to a NGH storage depot. Optionally, the storage depot may be located in the regasification facility.

At 618, in an optional step, NGH hull 302 is to be stored in a storage depot until regasification is required. Prior to storing NGH hull 302, dismantable systems and structures, and removable equipment, accessories and components, all of which may have been fixed to the hull during assembly of marine vessel 100 in step 614 may be removed. The storage depot may be under water, where the NG hull 302 may be submerged in water (e.g. seawater) and solid NG 304 may be maintained in its solid state by use of pressure and/or cooling as previously described in step 610, as applicable. Optionally, the underwater storage depot may be on the seabed. NG hull 302 may be held in place in the underwater storage depot by means of anchoring or use of weights. Alternatively, the underwater storage depot may be replaced by a dry land storage depot.

At 620, NG hull 302 may be regasified in the regasification facility. If following from step 618, the hull may be released from underwater and allowed to float to the water surface and transported to the regasification facility (if the underwater storage depot is not in the regasification facility). If following from step 616, the dismantling process described in step 618 may be performed in the regasification facility. Known techniques for regasification may be used.

At 622, the gas produced during regasification and contained inside the enveloping outer insulating skin layer 310 is extracted for distribution.

At 624, once all the gas is removed, all non-NGH components including skeletal structure 313 and other structural components may be disassembled and the structural elements (312, 314A and 314B) individually arranged for shipping. Some, or optionally all, of the non-GH components may be reshipped to the production facility for fabricating a new NGH hull 302 and a new NGH marine vessel 100. Shipping may optionally be done using commercially-available overland and marine transport means.

Figure 7:
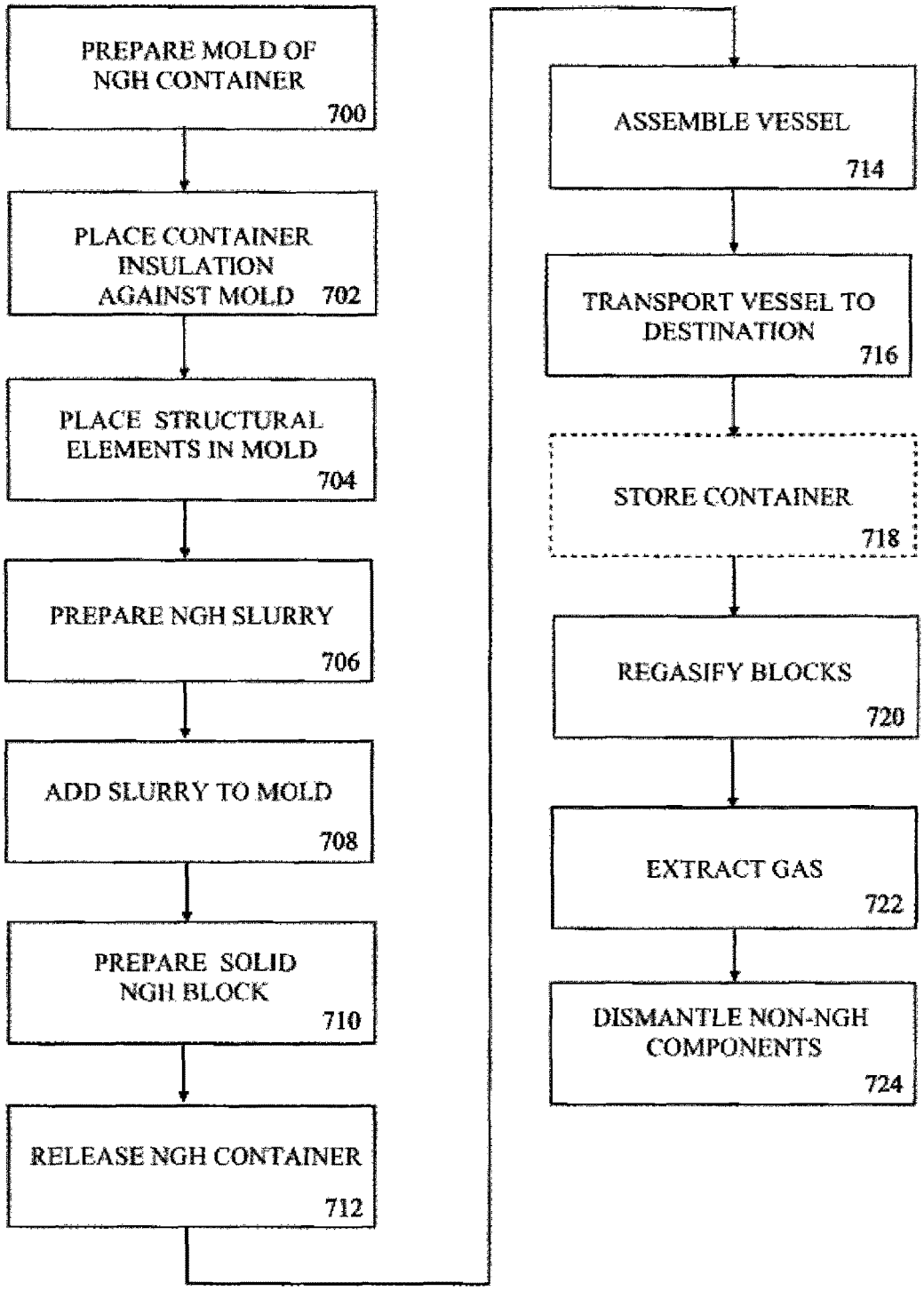
FIG. 7 is a flow chart of an exemplary method of producing a solid NGH container for assembling a NGH container hull and a NGH marine vessel operative to transport and store solid NGH, according to an embodiment of the present invention.

Reference is now made to FIG. 7 which is a flow chart of an exemplary method of producing a NGH container for assembling a NGH container hull and a NGH marine vessel operative to transport and store NGH, according to an embodiment of the present invention. The skilled person may appreciate that the exemplary method shown and described herein below may be practiced with modifications, which may include more or less steps and/or a different sequence of steps. For convenience, the method is described with reference to the embodiment of the present invention shown in FIGS. 5A-5E, although the skilled person may readily appreciate that the method may be similarly practiced with other embodiments of the present invention.

At 700, a mold contoured to the shape of solid NGH container 505 is prepared. Optionally molds contoured to the shapes of NGH containers 507 and 509 are also prepared.

At 702, barrier 511 is placed inside the mold following the contour of solid NGH container 505 (optionally also containers 507 and 509). Barrier 511 may serve as an envelope to contain the NGH slurry when poured into the mold, as described in the following steps.

At 704, skeletal structure 513 and other required structural elements are assembled inside the mold enveloped by barrier 511. The assembled mold may be submerged in water, for example, in sea water. Alternatively, the assembled mold may be partially submerged in water, or left on dry land.

At 706, a NGH slurry is prepared using known techniques. Additives 516 are added to the slurry.

At 708, the NGH slurry with the additives is poured into the barrier 511 inside the mold, in the required quantity according to the volume of NGH to be transported inside NGH container 505 (optionally also containers 507 and 509).

At 710, the slurry is solidified to form solid NGH 504. Known techniques may be used to form the solid NGH 504, and may include use of pressure and/or cooling. Pressurization may include the use of pressurizing equipment and/or water depth pressure when submerged in water and may range from, but not be limited to 0-100 bars. Cooling may include use of cooling equipment and cooling temperature may range from, but not be limited to 0°-minus 50° C. NGH container 505 (optionally also containers 507 and 509) may be left submerged in water, stored inside the mold once formed until needed. Alternatively, the mold may be removed under water and the NGH containers may remain stored under water as required. Alternatively, the NGH containers may be left on dry land either inside or outside the mold. Whether submerged or outside of the water, cooling is maintained.

At 712, NGH container 505 (optionally containers 507 and 509) is released for use. If submerged in water, the buoyancy of the container will cause it to float to the water surface when released. The NGH container may then be moved to a dry dock for assembling NGH container hull 502 and NGH marine vessel 200. If on dry land, NGH container 505 (optionally containers 507 and 509) may be transported to the dry dock for marine vessel assembly. Optionally, the assembly may be done without a dry dock.

At 714, NGH container hull 502 and NGH marine vessel 200 is assembled. Marine vessel 200 may be a self-propelled marine vessel or a towable vessel. Dismantable propulsion and navigation systems, dismantable structures, and other removable equipment, accessories, and components, as applicable depending on whether the vessel is self-propelled or towable, may be fitted onto NGH container hull 502 following assembly. NGH container hull 502 may be assembled by arranging the NGH containers one on top of the other and side by side, and enveloping the stacked configuration in skin layer 510. Optionally, bow 206 and stern 208 (see FIG. 2) may be attached to NGH container hull 502. Methods known in the art may be used to mechanically attach NGH container 505 (optionally containers 507 and 509) to one another.

At 716, NGH marine vessel 200 travels to its destination which may be a regasification facility. Alternatively, NGH marine vessel 200 may travel to a NGH storage depot. Optionally, the storage depot may be located in the regasification facility.

At 718, in an optional step, NGH container 505 (optionally also containers 507 and 509) is to be stored in a storage depot until regasification is required. Prior to storing the NGH containers, dismantable systems and structures, and removable equipment, accessories and components, all of which may have been fixed to the hull during assembly of NGH hull 502 and marine vessel 200 in step 714 may be removed. NGH container hull 502 may also be dismantled to allow individual access to each container. The storage depot may be under water, where the NG containers may be submerged in water (e.g. seawater) and solid NG 504 may be maintained in its solid state by use of pressure and/or cooling as previously described in step 710, as applicable. Alternatively, the underwater storage depot may be replaced by a dry land storage depot. Optionally, NGH container hull 502 is not dismantled and all NGH containers are stored together in the hull.

At 720, NG container 505 (optionally also containers 507 and 509) may be regasified in the regasification facility. If following from step 718, the container (optionally the hull) may be released from underwater and allowed to float to the water surface and transported to the regasification facility (if the underwater storage depot is not in the regasification facility). If following from step 716, the dismantling process described in step 618 may be performed in the regasification facility. Known techniques for regasification may be used.

At 722, the gas produced during regasification and contained inside the enveloping insulation layer 511 is extracted for distribution.

At 724, once all the gas is removed, all non-NGH components including skeletal structure 513 and other structural components may be disassembled and the structural elements (512, 514A and 514B) individually arranged for shipping. Some, or optionally all, of the non-GH components may be reshipped to the production facility for fabricating new NGH containers, a new NGH hull 502 and a new NGH marine vessel 200. Shipping may optionally be done using commercially-available overland and marine transport means.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

The invention claimed is:

1. A marine vessel to transport natural gas hydrates (NGH) comprising:

a hull formed from solid NGH; and a skeletal structure to support said hull.

2. A marine vessel according to claim 1 wherein said solid NGH comprises additives.

3. A marine vessel according to claim 2 wherein said additives comprise any one of sand, clay, wood, hemp, and phase changing materials.

4. A marine vessel according to claim 1 further comprising a liner to envelop an exterior of said hull.

5. A marine vessel according to claim 4 wherein said liner is hydrophobic.

6. A marine vessel according to claim 4 wherein said liner is hermetically sealed to gas and liquids.

7. A marine vessel according to claim 4 wherein said liner is thermally insulating.

8. A marine vessel according to claim 1 wherein said hull is integrally formed from solid NGH.

9. A marine vessel according to claim 1 wherein said hull is formed from sections of solid NGH.

10. A marine vessel according to claim 1 wherein said hull is formed from a plurality of containers comprising said solid NGH.

11. A marine vessel according to claim 9 wherein said skeletal structure is comprised in said plurality of containers.

12. A marine vessel according to claim 1 wherein the vessel is one of a self-propelled vessel or a towable vessel.

13. A marine vessel according to claim 1 wherein said skeletal structure is suitable to transport a cooling fluid through said solid NGH.

14. A marine vessel according to claim 1 wherein said solid NGH is frozen.

15. A method of fabricating a marine vessel for transporting and storing natural gas hydrates (NGH), the method comprising:

preparing a mold;

placing a skin layer in said mold;

assembling a skeletal structure in said mold;

preparing a NGH slurry; and pouring said NGH slurry into said mold.

16. A method according to claim 15 further comprising mixing an additive into said NGH slurry.

17. A method according to claim 15 further comprising solidifying said NGH slurry.

18. A method according to claim 15 comprising solidifying said NGH slurry into a section of a hull of the marine vessel.

19. A method according to claim 15 comprising shaping said NGH slurry into a frozen solid block.

20. A method according to claim 15 further comprising submerging said mold in water.

21. A method according to claim 15 further comprising storing said solid NGH submerged in water.

22. A method according to claim 15 further comprising dismantling said skeletal structure following regasification of the solid NGH.

23. A container to transport natural gas hydrates (NGH) comprising:

a block of solid NGH; and a skeletal structure to support said block, wherein said solid NGH comprises additives.

24. A container according to claim 23 wherein said additives comprise any one of sand, clay, wood, hemp, and phase changing materials.

25. A container to transport natural gas hydrates (NGH) comprising:

a block of solid NGH;

a skeletal structure to support said block; and a barrier to envelop an exterior of said solid NGH block.

26. A container according to claim 25 wherein said barrier is hydrophobic.

27. A container according to claim 25 wherein said barrier is hermetically sealed to gas and liquids.

28. A container according to claim 25 wherein said barrier is thermally insulating.

29. A container according to claim 23 wherein said container is transportable on a marine vessel.

30. A container to transport natural gas hydrates (NGH) comprising:

a block of solid NGH; and a skeletal structure to support said block, wherein said container is suitable to form a hull of a marine vessel.

31. A container according to claim 23 wherein said container is transportable on a commercial overland transport vehicle.

32. A container according to claim 23 wherein said skeletal structure is suitable to transport a cooling fluid through said block of solid NGH.

* * * * *